US005169066A

United States Patent [19]

Ricco et al.

[11] Patent Number: 5,169,066

[45] Date of Patent: Dec. 8, 1992

[54] CONTROL VALVE AND ANCHOR FOR AN ELECTROMAGNETIC INTERNAL COMBUSTION ENGINE FUEL INJECTOR

[75] Inventors: Mario Ricco, Bari; Sisto L. De Matthaeis, Modugno; Rita Di Gioia, Bari, all of Italy

[73] Assignee: Elasis Sistema Ricerca Fiat Nel Mezzogiorno Societa, Pomigliano D'Arco, Italy

[21] Appl. No.: 783,418

[22] Filed: Oct. 28, 1991

[30] Foreign Application Priority Data

Oct. 31, 1990 [IT] Italy ..... 53354/90[U]

[51] Int. Cl.[5] ..... B05B 51/06; B05B 61/10

[52] U.S. Cl. ..... 239/96; 239/533.8; 239/533.11; 239/585.2; 239/585.3

[58] Field of Search ..... 239/88, 96, 533.8, 533.9, 239/533.11, 585.1, 585.2, 585.3; 251/129.18

[56] References Cited

U.S. PATENT DOCUMENTS

| | | | |
|---|---|---|---|
| 4,247,052 | 1/1981 | Gray | 239/585.2 |
| 4,311,280 | 1/1982 | Knape | 239/585.2 |
| 4,361,846 | 1/1983 | Akagi | 239/96 |
| 4,573,659 | 3/1986 | Homes | 239/533.9 X |
| 4,978,074 | 12/1990 | Weinand | 251/129.18 X |
| 5,046,472 | 9/1991 | Linder | 239/585.3 X |

FOREIGN PATENT DOCUMENTS

| | | |
|---|---|---|
| 0385397 | 9/1990 | European Pat. Off. . |
| 2051944 | 10/1970 | Fed. Rep. of Germany . |
| 85/01561 | 4/1985 | PCT Int'l Appl. . |

*Primary Examiner*—Andres Kashnikow
*Assistant Examiner*—William Grant
*Attorney, Agent, or Firm*—Baker & Daniels

[57] ABSTRACT

A control valve for an injector comprising a valve body having of a control chamber connected to a drain conduit via a hole terminating at a flat surface of the valve body. The plunger of the valve consists of a plate housed in a seat, the bottom wall of which arrests the travel of the plate after a travel "b". This is controlled by the armature of an electromagnet, which armature presents a rod arrested directly by an adjustable stop after traveling a distance "a" greater than travel "b". The opening and closing time of the valve is therefore unaffected by wear on the stop of the armature. The rod of the armature is in one piece with a stem activating the plate, and with a threaded portion screwed to the armature.

8 Claims, 2 Drawing Sheets

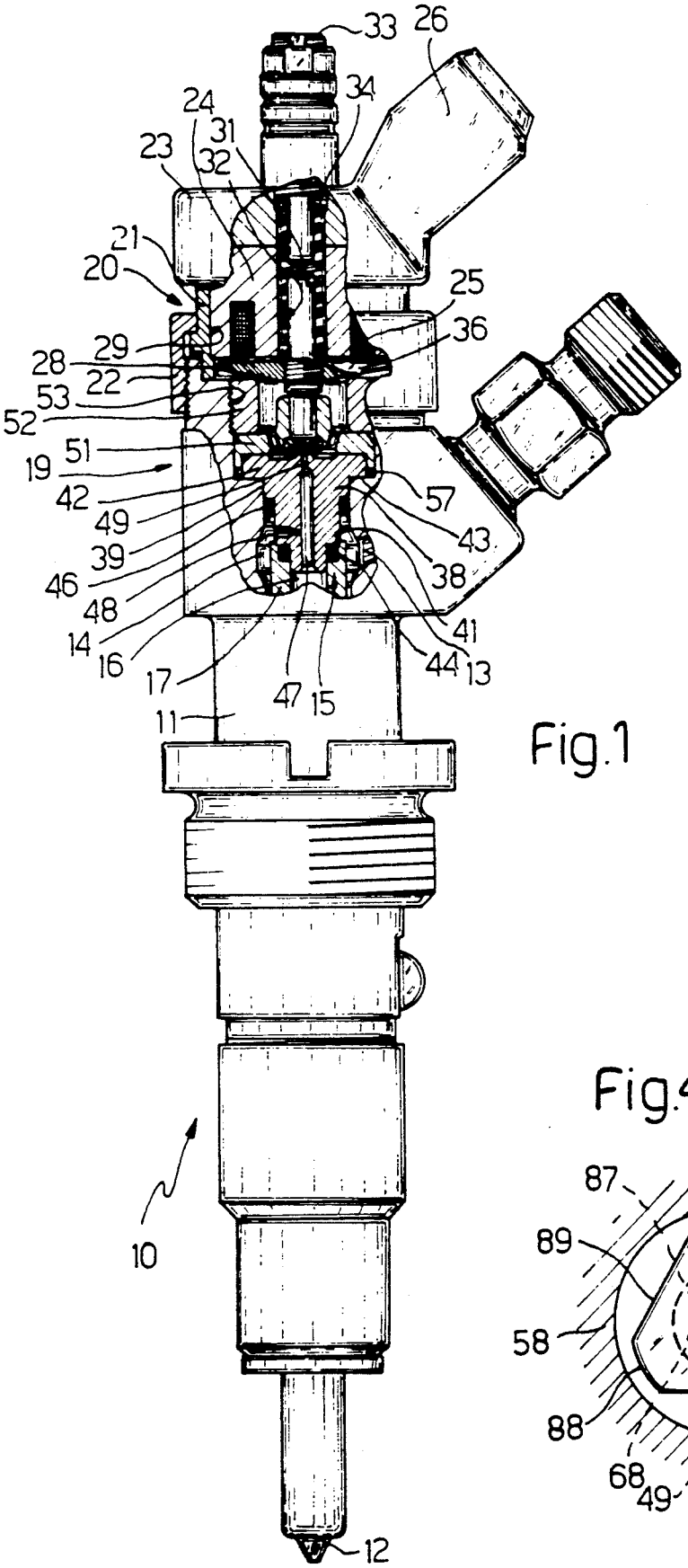
Fig.1
Fig.4
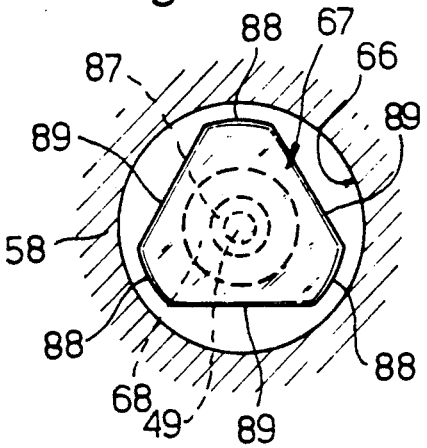

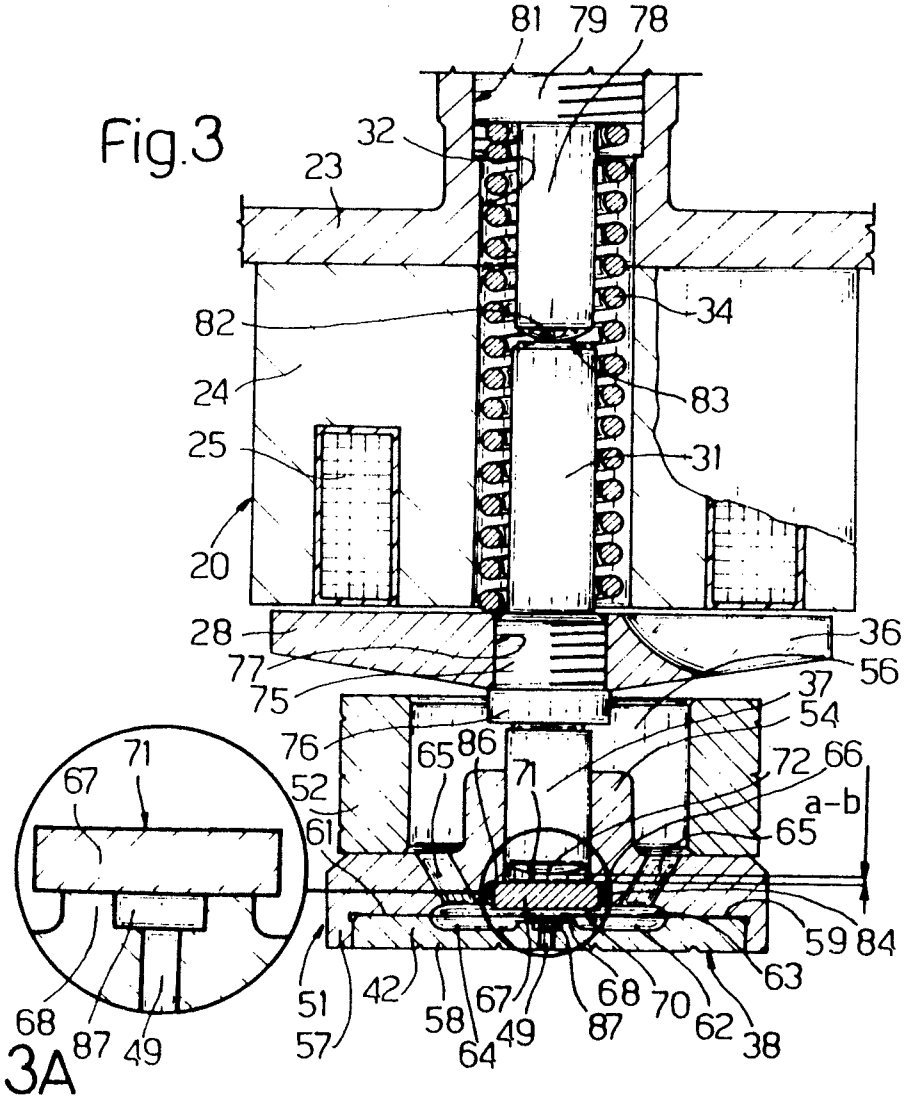
Fig.3
Fig.3A
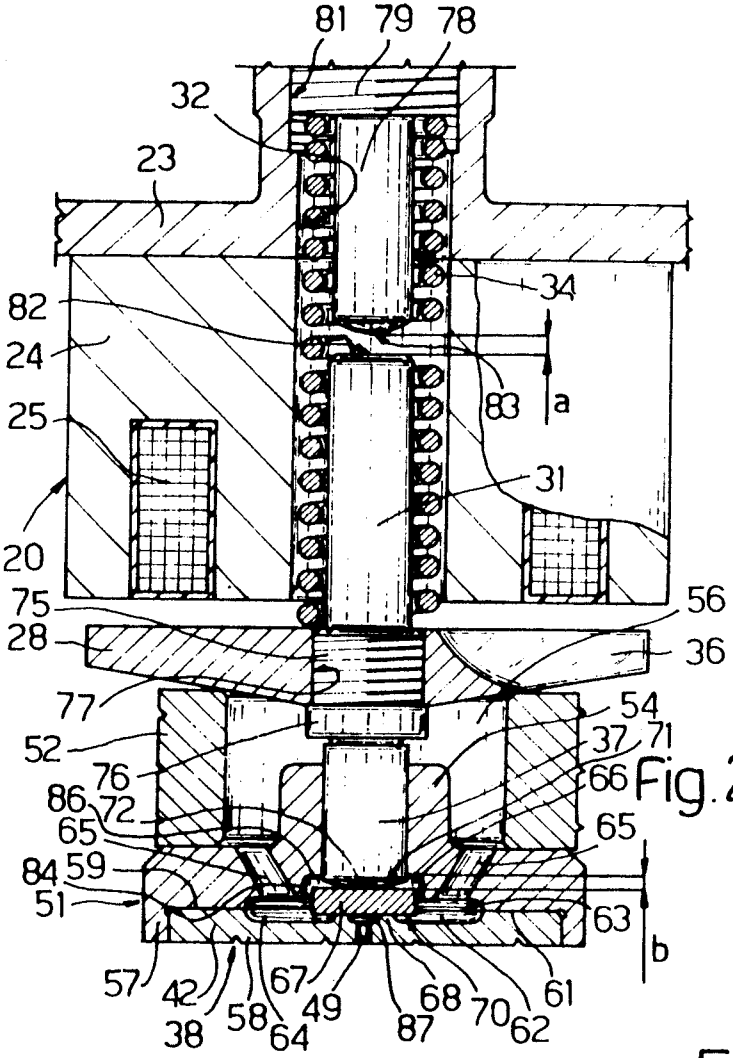
Fig.2

CONTROL VALVE AND ANCHOR FOR AN ELECTROMAGNETIC INTERNAL COMBUSTION ENGINE FUEL INJECTOR

BACKGROUND OF THE INVENTION

The present invention relates to an electromagnetic injector for internal combustion engine fuel injection systems.

Injectors of the aforementioned type normally comprise a body with a nozzle which, for injecting fuel, is opened by a control valve which connects the control chamber of the nozzle to a drain conduit. The nozzle is normally closed by a plunger and the fuel pressure inside the control chamber, and is opened by the control valve reducing the pressure inside the chamber and raising the plunger.

The control valve on known injectors normally comprises a ball cooperating with a conical seat in a hole connecting the control chamber to the drain conduit. The ball is controlled by an element on the anchor of an electromagnet, the travel of which is such that the ball remains permanently contacting the element. Normally, the anchor also presents a rod having a conical free surface which, by means of a second ball, is arrested on an adjustable stop, also having a conical free surface, for enabling adjustable alignment of the rod in relation to the stop.

Control valves of the aforementioned type present numerous drawbacks. Foremost of these is that continual contact between the plunger and the anchor element requires highly accurate adjustment of the travel of the anchor. Moreover, the relatively heavy weight of the moving parts involved results in both sluggish closure and severe wear of the plunger due to impact.

Finally, as stoppage of the anchor by means of the second ball and the two conical seats occurs along two contact circumferences, the severe pressures involved result in the ball rutting each conical surface and forming an impression or recess. This results in impaired performance of the ball and a variation in the travel of the anchor, thus requiring frequent adjustment of the stop.

SUMMARY OF THE INVENTION

It is an object of the present invention to provide an electromagnetic fuel injector featuring a highly straightforward control valve and anchor, designed to overcome the above drawbacks typically associated with known injectors.

According to the present invention, there is provided an electromagnetic injector comprising a control valve for opening an injection nozzle and in turn comprising a hole connecting a control chamber to a drain conduit, and a plunger controlled by the anchor of an electromagnet, stop means being provided for arresting the travel of said anchor when attracted by said electromagnet; characterised by the fact that the travel of said plunger is arrested by a stop independent of said stop means and such that the travel of said plunger is less than that of said anchor.

BRIEF DESCRIPTION OF THE DRAWINGS

A preferred non-limiting embodiment of the present invention will be described by way of example with reference to the accompanying drawings, in which:

FIG. 1 shows a partially-sectioned view of an electromagnetic injector in accordance with the present invention;

FIG. 2 shows a larger-scale section of the control valve on the FIG. 1 injector;

FIG. 3 shows a section of the FIG. 2 control valve in a different operating position;

FIG. 4 shows a larger-scale plan view of a variation of a detail on the valve.

DETAILED DESCRIPTION OF THE INVENTION

Number 10 in FIG. 1 indicates an internal combustion engine fuel injector comprising a tapered hollow body 11 fitted at the bottom with an injection nozzle 12 communicating with a normal high pressure (e.g. 1500 bar) chamber not shown.

In known manner, the high pressure chamber is supplied by a pressurized fuel input conduit 13 via an annular chamber 14 and an inner conduit not shown. From conduit 13, the fuel is supplied by a high pressure (e.g. 1500 bar) pump not shown.

Body 11 is fitted inside with a bush 15 having a cylindrical axial cavity 16 housing an axially-sliding rod 17 pushed down by a coaxial spiral spring. Rod 17 extends downwards and terminates at the bottom in a tip designed to engage a seat inside nozzle 12 of which it therefore acts as the plunger.

Rod 17 is controlled by a valve 19 in turn controlled by an electromagnet 20 on a bush 21 secured to body 11 by ring nut 22. Bush 21 is fitted with a cap 23 closing the top of body 11.

Electromagnet 20 comprises a magnetic core 24 housing an electric coil 25 supplied by an electric connection on appendix 26 of cap 23. Electromagnet 20 also comprises a magnetic armature in the from of a disc 28 housed inside a cylindrical portion 29 of the inner wall of bush 21. Disc 28 is fitted to a rod 31 inserted inside an axial hole 32 in core 24 and communicating with a fuel drain conduit 33.

Hole 32 also houses a helical compression spring for pushing disc 28 downwards. Disc 28 presents a radial opening 36 communicating with axial hole 32, and is integral at the bottom with an actuator for control valve 19, consisting of a stem 37 on the opposite side of disc 28 to rod 31.

Control valve 19 comprises a substantially cylindrical valve member or body 38 housed in a compartment 39 extending upwards of annular chamber 14. Body 38 presents, at the bottom, a shoulder 41 sealed inside a seat on the top end of bush 15, and, at the top, a flange 42 resting on a shoulder 43 of body 11. A second shoulder 44 on body 38 houses a seal 46 for upwardly sealing annular chamber 14.

Body 38 presents a coaxial, cylindrical control chamber 47 communicating at the bottom with cavity 16; with annular chamber 14 via radial hole 48, for receiving pressurized fuel from conduit 13; and externally at the top via a calibrated axial hole 49 terminating on flat surface 68 of body 38.

Flange 42 of body 38 is integral with a bell-shaped member 51 secured to hollow body 11 by a threaded ring nut 52 screwed inside a threaded seat 53 on body 11. Member 51 comprises a sleeve 54 forming an annular chamber 56 with the inner surface of ring nut 52. The inner surface of sleeve 54 acts as a precision guide for actuator 37 of valve 19.

Bell-shaped member 51 also comprises a ring 57 (FIG. 2) surrounding flange 42 of body 38 so that member 51 keeps sleeve 54 centered in relation to body 38. Finally, member 51 comprises a flange 58 having a flat annular portion 59 engaging, by means of ring nut 52, a flat annular portion 61 of flange 42. The upper surface of flange 42 comprises a depression 62 forming an annular chamber 64 with a matching depression 63 on flange 58. Annular chamber 64 communicates with annular chamber 56 via two or more inclined holes 65 through flange 58. According to the present invention, rod 31 is in one piece with a threaded portion 75, a flange 76 and stem 37. Rod 31 and stem 37 are secured rigidly to disc 28 by screwing threaded portion 75 inside a threaded hole 77 on disc 28 until flange 76 contacts the surface of disc 28. To prevent accidental workout of portion 75, this may be torqued further or distort part of the two connecting threads.

As compared with known methods, e.g. welding or riveting, the above connection provides for greater reliability by virtue of the increased contact surface of the two threads. Moreover, due to the severe pressure and operating rate involved, known connections are invariably subject to breakage.

For arresting upward travel of disc 28, cap 23 is fitted with an adjustable stop consisting of a stem 78 in one piece with a threaded pin 79 screwed inside a threaded seat 81 on cap 23. Seat 81 is coaxial with hole 32 and presents a number of axial recesses enabling communication with drain conduit 33 (FIG. 1). A shoulder between pin 79 and stem 78 supports one end of spring 34.

The free surface 82 of rod 31 is flat, while the free surface 83 of stem 78 is rounded, i.e. in the form of a spherical tip 83, which provides for directly arresting surface 82 after a given travel "a" (FIG. 2). Spherical tip 83 also allows a certain amount of misalignment of rod 31 in relation to stem 78 due to inevitable machining tolerances.

Plunger 67 for plugging hole 49 consists of a plate, e.g. a round plate, with two flat opposite faces 70 and 71. The surface of face 70 rests in sealed manner on surface 68 of body 38, for which purpose both surface 68 and the surface of face 70 are machined to a high degree of precision. Face 71, on the other hand, is engaged by end surface 72 of stem 37, which is slightly rounded, i.e. also in the form of a spherical tip.

Plate 67 is housed in a seat consisting of a further substantially cylindrical depression 66 formed on flange 58 and coaxial with bell-shaped member 51. Depression 66 comprises a lateral wall 84 (FIG. 3) and a bottom wall 86 for arresting upward travel of plate 67.

Depression 66 is so sized as to allow plate 67 a certain amount of radial clearance in relation to lateral wall 84, while at the same time fully covering surface 68, thus enabling plate 67 to move freely in the axial direction. Bottom wall 86 is so located that, when plate 67 is released by stem 37, upward travel of plate 67 due to the fuel pressure inside chamber 47 is arrested after a distance "b" substantially shorter than travel "a" of rod 31 and, consequently, disc 28.

Hole 49 connecting chamber 47 to annular chamber 64 presents a larger-diameter hole portion 87 terminating at flat surface 68 of flange 42, for obtaining a greater discharge coefficient for a given travel of plate 67. Plate 67 must, if course, be such as to cover the whole of portion 87.

For increasing the discharge coefficient, by way of an alternative or in addition to portion 87, plate 67 may be polygonal in shape, e.g. faceted in such a manner as to produce alternating circular and flat portions 88, 89 (FIG. 4). Such a design may conveniently consist of three identical flat faces 89 with three alternating identical circular portions 88 as shown in FIG. 4.

The injector according to the present invention operates as follows.

Electromagnet 20 is normally de-energized, in which case, disc 28 is detached from core 24 by spring 34 (FIG. 2); plate 67 is held down by stem 37 so as to close portion 87 and hole 49; and, via cavity 16, the fuel pressure in control chamber 47 (FIG. 1) combines with the respective spring for forcing rod 17 downwards with its bottom end closing nozzle 12.

When electromagnet 20 is energized (FIG. 2), disc 28 moves up, thus causing stem 37 to release plate 67, which is raised by the fuel pressure in chamber 47 and arrested, after a given travel "b" (FIG. 3), by wall 86 of depression 66.

Rod 31 of disc 28, on the other hand, moves up by a greater distance "a", until surface 82 contacts tip 83 of rod 78. To prevent disc 28 from adhering to core 24, travel "a" is such as to prevent contact between the two. In the topmost limit position, a clearance of "a-b" exists between tip 72 of stem 37 and face 71 of plate 67.

The fuel in chamber 47 now flows through hole 49, portion 87 and faces 89 (if any) (FIG. 4) into annular chamber 64 (FIG. 3) and from there through inclined holes 65 into annular chamber 56 and towards drain conduit 33. As stop 86 is wearproof, travel "b" of plate 67 remains constant and, even though the dropdown time of anchor 28 may be increased to some extent by wear, the opening time of valve 19 is invariable.

Travel "b", however, provides immediately for a maximum discharge coefficient for restoring the pressure inside control chamber 47 (FIG. 1) and so lowering rod 17 to close nozzle 12. The fall in pressure inside control chamber 47 then causes rod 17 to move upwards, thus opening nozzle 12 for injecting fuel inside the engine cylinder.

When electromagnet 20 is de-energized, spring 34 (FIG. 3) forces disc 28 back down; and stem 37, after covering a distance of "a-b", re-engages and restores plate 67 to the closed position over portion 87 and hole 49. Upon stem 37 engaging plate 67, therefore, the inertia of armature 28, 31, 37 is at least partially borne by plate 67, which is thrust on to surface 68 for more rapidly closing chamber 47.

The advantages of the injector according to the present invention will be clear from the foregoing description. In addition to increasing the opening and closing speed of the control valve, it also provides for practically eliminating adjustment of stem 78. Injection, in fact, is no longer determined by the travel of the armature, while the weight of plate 67 is so small as to practically eliminate any wear of stop 86. Moreover, direct stoppage of rod 31 by stem 78 eliminates any variation in travel caused by the ball rutting the two free surfaces, and the machining involved is considerably cheaper than the conical surface machining required by known injectors.

To those skilled in the art it will be clear that changes may be made to the injector as described and illustrated herein without, however, departing from the scope of the present invention. For example, upper surface 72 of plate 67 may be hollow or curved and engaged by a complementary surface on stem 37; electromagnet 20 and valve body 38 may be fitted differently to body 11 of injector 10; and hole portion 87, instead of being cylindrical, may be defined by a conical surface increasing in diameter towards plate 67, for facilitating flow and preventing swirl.

We claim:

1. An electromagnet internal combustion engine fuel injector comprising a control valve (19) for opening an injection nozzle (12) and in turn comprising a hole (49) connecting a control chamber (47) to a drain conduit (33), and a plunger (67) controlled by the armature (28) of an electromagnet (20), stop means (78) being provided for arresting the travel (a) of said armature (28) when attracted by said electromagnet (20); characterised by the fact that the travel of said plunger (67) is arrested by a stop (86) independent of said stop means (78) and such that the travel (b) of said plunger (67) is less than that (a) of said armature (28).

2. An injector as claimed in claim 1, wherein said armature consists of a disc (28) integral with a rod (31), and wherein said stop means comprises an element (78) on an adjustable pin (79) coaxial with said rod (31); characterised by the fact that a free surface (83) of said element (78) is rounded and provides for directly arresting a free surface (82) of said rod (31).

3. An injector as claimed in claim 2, characterised by the fact that said hole (49) terminates at a flat surface (68) of a valve member (38); said plunger consisting of a plate (67) having a flat face (70) mating with said flat surface (68); the opposite face (71) of said plate (67) being engaged by a stem (37) integral with said rod (31) and extending from the opposite side of said disc (28) in relation to said rod (31).

4. An injector as claimed in claim 3, characterised by the fact that said rod (31) comprises a threaded portion (75) by which it is rigidly secured to said disc (28); said stem (37) being in one piece with said rod (31) and guided by a sleeve (54) fitted to said valve member (38).

5. An injector as claimed in claim 4, characterised by the fact that said valve member (38) is sealed inside a hollow body (11) by means of a threaded ring nut (52) and a bell-shaped member (51) supporting said sleeve (54); said plate (67) moving inside a seat (66) formed in said bell-shaped member (51) and comprising said stop (86).

6. An injector as claimed in claim 2, characterised by the fact that said hole (49) terminates in a larger-diameter portion (87) for increasing the discharge coefficient of the fuel from said chamber (47).

7. An injector as claimed in claim 3, characterised by the fact that said plate (67) is shaped substantially as a polygon for facilitating the fall in pressure of said chamber (47) when said chamber (47) is connected to said drain conduit (33).

8. An injector as claimed in claim 7, characterised by the fact that said polygon comprises a series of alternating flat (89) and rounded (88) sides.

* * * * *

UNITED STATES PATENT AND TRADEMARK OFFICE

CERTIFICATE OF CORRECTION

PATENT NO. : 5,169,066

DATED : December 8, 1992

INVENTOR(S) : Mario Ricco, et. al.

It is certified that error appears in the above-indentified patent and that said Letters Patent is hereby corrected as shown below:

On the Title page, item [73], Assignee: after "Societa" insert --Consortile per Azioni--.

Signed and Sealed this

Fifth Day of April, 1994

Bruce Lehman

*Attest:*

BRUCE LEHMAN

*Attesting Officer*

*Commissioner of Patents and Trademarks*